US008320783B2

(12) United States Patent
Ogata et al.

(10) Patent No.: US 8,320,783 B2
(45) Date of Patent: Nov. 27, 2012

(54) IMAGE FORMING APPARATUS WITH A PLURALITY OF PRIMARY TRANSFER SECTIONS

(75) Inventors: Satoshi Ogata, Hachioji (JP); Atsushi Takahashi, Akishima (JP); Jun Onishi, Hino (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 346 days.

(21) Appl. No.: 12/621,578

(22) Filed: Nov. 19, 2009

(65) Prior Publication Data

US 2010/0129104 A1 May 27, 2010

(30) Foreign Application Priority Data

Nov. 25, 2008 (JP) ..... 2008-299237

(51) Int. Cl.
*G03G 15/16* (2006.01)

(52) U.S. Cl. ..... 399/66; 399/85; 399/86; 399/301; 399/302

(58) Field of Classification Search ..... 399/66, 399/82, 85, 86, 167, 299, 301, 302
See application file for complete search history.

(56) References Cited

U.S. PATENT DOCUMENTS 5,515,154 A * 5/1996 Hasegawa et al. ..... 399/303
6,148,163 A * 11/2000 Ito ..... 399/67
2003/0095815 A1 5/2003 Nakagawa et al.
2007/0292170 A1 12/2007 Yoshioka
2008/0145084 A1* 6/2008 Toizumi et al. ..... 399/66

FOREIGN PATENT DOCUMENTS

JP 2001-201902 A 7/2001
JP 2005-156776 A 6/2005
JP 2005141108 A * 6/2005

OTHER PUBLICATIONS

European Search Report issued in the corresponding Application No. 09176156.9-2209 dated Feb. 17, 2010.

* cited by examiner

*Primary Examiner* — David Gray
*Assistant Examiner* — Laura Roth
(74) *Attorney, Agent, or Firm* — Buchanan Ingersoll & Rooney PC

(57) ABSTRACT

A first mode to form a toner image of single color where a pressure contact release section T changes a primary transfer section 7 to be in a pressure contact state, and a second mode to form an overlapped toner image where the pressure contact device T changes a plurality of the primary transfer sections 7 to be in the pressure contact state can be executed, wherein a speed difference D1 between an image carrier 1 and an intermediate transfer belt 6 in the first mode is controlled to be greater than a speed difference D2 between the image carrier 1 and the intermediate transfer belt 6 in the second mode.

5 Claims, 6 Drawing Sheets

IMAGE FORMING APPARATUS WITH A PLURALITY OF PRIMARY TRANSFER SECTIONS

This application is based on Japanese Patent Application No. 2008-299237 filed on Nov. 25, 2008, in Japanese Patent Office, the entire content of which is hereby incorporated by reference.

TECHNICAL FIELD

The present invention relates to an image forming apparatus such as a copying machine, a printer and a facsimile machine having a plurality of image carriers at a periphery of an intermediate transfer belt.

BACKGROUND

In recent years, with a trend of developing high speed and highly-functional image forming apparatuses, image forming apparatuses of tandem method using intermediate transfer belts have become available in the marketplace. The image forming apparatus using the intermediate transfer belt is usually provided with image forming units configured with image carriers to develop different colors of toner, charging devices, writing devices, developing devices and cleaning devices at a vicinity of the intermediate transfer belt. By the image forming units, a plurality of colors of toner images are transferred and overlapped onto the intermediate transfer belt to form a color image and then collectively transferred onto a sheet at a transfer position. (For example, Patent Document 1: Unexamined Japanese Patent Application Publication No. 2001-201902)

In an image forming apparatus of the tandem method, it is not always preferable that the speed of the intermediate transfer belt is equal to that of a photoconductive drum, and in the Patent document 1, to prevent shedding phenomenon at the time transfer, the difference of the moving speed between the intermediate transfer belt and the photoconductive drum is purposely created.

Also, in the image forming apparatus of the tandem method, a monochrome mode, in which only the black toner is used, may be carried out. In case the monochrome mode is carried out with the speed difference, in the photoconductive drums which do not carry out image forming, there have been problems that abrasion was accelerated and scratches were likely to be created by grazing with the intermediate transfer belt, whereby the life is shortened. To cope with the above problem, in the image forming apparatus of Patent Document 1, in a single color mode, the moving speed of the photoconductive drums which do not carry out image forming are controlled to be equal to the moving speed of the intermediate transfer belt.

An image forming apparatus disclosed in the patent document 2 (Unexamined Japanese Patent Application Publication No. 2005-156776), there is provided a primary transfer roller which biases the intermediate transfer belt onto the photoconductive drum. By retracting the primary transfer roller, the intermediate transfer belt can be displaced from a position where the belt is biased onto the photoconductive drum to a released position. In the monochrome mode, by retracting the primary roller to bias the photoconductive drum which is not involved in image forming, extension of lives of the photoconductive drums and developing devices which are not used for image forming is realized.

Patent Document 1: Unexamined Japanese Patent Application Publication No. 2001-201902

Patent Document 2: Unexamined Japanese Patent Application Publication No. 2005-156776

In the image forming apparatus of the tandem method, positional accuracy among the toner images formed by individual image forming units is important since an insufficient positional accuracy causes color shift among the toner images.

To ensure the positional accuracy, it is important that rotation of the intermediate transfer belt is controlled with high accuracy, and the moving speed of the photoconductive drum is slower than that of the intermediate transfer belt in some cases for the following reasons:

In case a load of a drive system of the intermediate transfer belt is fluctuated, the rotation speed becomes unstable due to effects of elastic deformation of the drive system and play of gears engaged. If the belt rotates with a load more than a prescribed load, the above effect can be reduced, thus in order to rotate with high accuracy, it is preferred to drive rotation of the belt while applying the load more than the prescribed load.

As a device to apply the load, a brake disposed at the drive system of the intermediate transfer belt can be considered. However because of a complicated mechanism and difficulty of applying the prescribed load for a long period of time, it is not a practical. Whereby it is considered that by making the moving speed of the photoconductive drum slower, the load is applied from the photoconductive drum to the intermediate transfer belt.

However, in the image forming apparatus described in Patent Document 2, in the monochrome mode, number of the photoconductive drums in contact with the intermediate transfer belt is one fourth of that in the full color mode. Thus there is concerned a problem that the load applied to the intermediate transfer belt is extremely reduced and an effect of load torque generated when the sheet passes through the secondary transfer section becomes large, whereby rotation of the intermediate transfer belt cannot be controlled with high accuracy.

Also, the image forming apparatus described in Patent Document 1, the moving speed of the photoconductive drum is changed for the monochrome mode and for the color mode, however since the speed is changed so as to match the moving speed of the photoconductive drum matches to that of the intermediate transfer belt, there is concern that the load of the intermediate transfer belt reduces. Also, since there is no mechanism to release the photoconductive drum, there is a concern that an effect to extend the life is not sufficient.

SUMMARY

The present invention has one aspect to solve the above problems in a configuration where the number of the photoconductive drums in contact with the intermediate transfer belt varies with the modes and an object of the present invention is to provide an image forming apparatus to control the intermediate transfer belt with high accuracy while optimizing color shift performance of the toner image and suppressing the effect caused by reducing number of the photoconductive drums being in contact.

The above object can be achieved by the following embodiment:

1. An image forming apparatus, comprising:

a plurality of image carriers on which different colors of toner images are formed respectively;

an intermediate transfer belt;

a plurality of primary transfer sections, disposed to respectively correspond to the plurality of the image carriers, to transfer each color of toner images formed on the plurality of the image carriers onto the intermediate transfer belt for forming an overlapped color toner image, wherein the primary transfer sections press the intermediate transfer belt from a back side so that the intermediate transfer belt comes in pressure contact with the image carriers so as to create transfer nips between the intermediate transfer belt and the image carriers;

a secondary transfer section to transfer the overlapped color toner image formed on the intermediate transfer belt onto a sheet;

a pressure contact release section to drive and switch the plurality of the primary transfer sections between a pressure contact state where the intermediate transfer belt is in pressure contact with the image carrier and a release state where the intermediate transfer belt is released from the image carrier;

a plurality of drive motors to drive rotation of the image carriers and the intermediate transfer belt independently and respectively, capable of varying each moving speed thereof; and a control section to control the pressure contact release sections and the drive motors, wherein a moving speed difference is a moving speed Vb of the intermediate transfer belt minus a moving speed Vd of the image carrier (where Vb>Vd), and the control section controls the pressure contact release section so as to execute a first mode to form a toner image wherein at least one primary transfer section is in the pressure contact state through the pressure contact release section, and a second mode to form the toner images wherein greater number of the primary transfer sections than that in the released state are in the pressure contact state, and controls the drive motors in accordance with the modes so that the moving speed difference in the first mode is greater than that in the second mode.

DESCRIPTION OF THE PREFERRED EMBODIMENTS

The present invention will be described with reference to the embodiments without being limited the embodiments thereof.

<Image Forming Apparatus>

Figure 1:
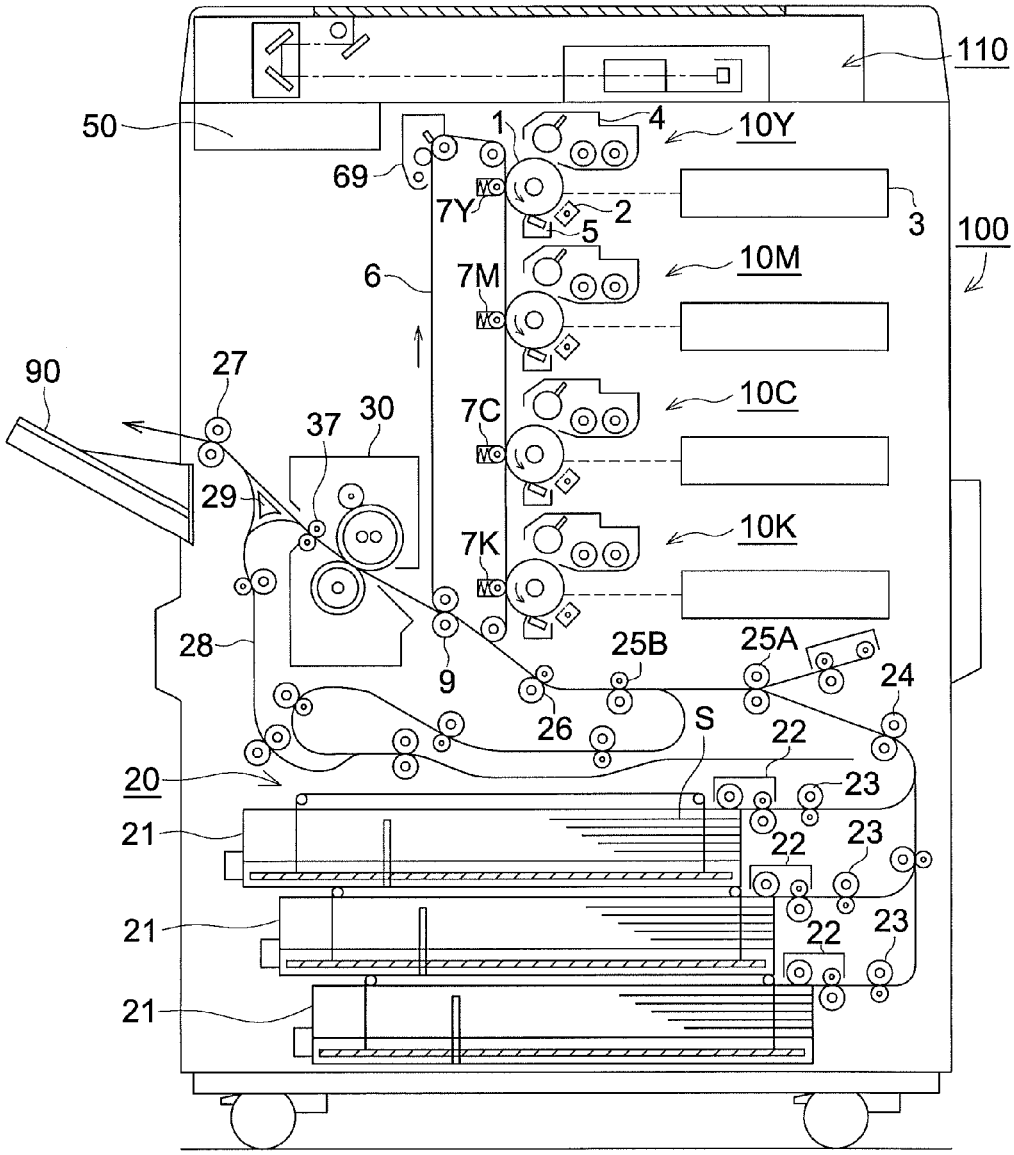
FIG. 1 is a view showing a relevant portion of an image forming apparatus 100.

An image forming apparatus related to the present embodiment will be described based on FIG. 1. FIG. 1 is a view showing relevant portions of an image forming apparatus 100.

The image forming apparatus 100 is so called a tandem method image forming apparatus configured with a plurality of sets of image forming devices 10Y, 10M, 10C and 10K, an intermediate transfer belt 6 in a shape of a belt, a sheet feeding device 20 and a fixing device 30.

At an upper portion of the image forming apparatus 100, a scanner 110 is disposed. A document placed on a document table is scanned through an optical system of a document image scanning exposure device of the scanner 110 and read by a line image sensor. An analogue signal having been subject to photoelectric conversion through the line image sensor is inputted to an exposure section 3 after analogue processing, A/D conversion, shading correction and image compression processing have been carried out.

Meanwhile, in the present specification, the elements are denoted collectively by reference symbols having no alphabetic suffix and elements of individual colors are denoted by reference symbols having suffixes i.e. Y (yellow), M (magenta), C (cyan) and K (black).

Each of an image forming device 10Y to form a yellow (Y) color image, an image forming device 10M to form a magenta (M) color image, an image forming device 10C to form a cyan (C) color image, and an image forming device 10K to form a black (K) color image, is provided with a charging electrode 2, an exposure section 3, a developing section 4 and a cleaning section 5 at a periphery of a photoconductive drum 1 in a shape of a drum representing a image carrier (in FIG. 1 reference symbols for M, C, and K are omitted).

The photoconductive drum 1 is, for example, composed of an organic photoconductive body which is configured by forming a photoconductive layer made of a resin having an organic photoconductive substance at an outer circumference of a metal base in the shape of the drum, and disposed in the way that the rotation axis of the photoconductive drum 1 is perpendicular to a conveyance direction of the sheet S (in FIG. 1, a direction perpendicular to the page surface).

The developing device 4 includes binary developer composed of toner and carrier having small particle diameter of different colors i.e. yellow (Y), magenta (M), cyan (C) and black (K).

The intermediate transfer belt 6 in a shape of a belt is supported rotatably by a plurality of rollers. The intermediate transfer belt 6 is an endless belt having a volume resistivity of $10^6$ to $10^{12}$ Ω·cm and is, for example, a semi-conductive seamless belt having a thickness of 0.04 to 0.10 mm where a conductive material is dispersed in engineering plastics such as modified polyimide, thermal curing polyimide, ethylene tetrafluoroethylene copolymer, polyvinylidene-fluoride and nylon alloy.

Toner images of individual colors formed on the photoconductive drum 1 by the image forming devices 10Y, 10M, 10C and 10K are successively transferred onto the intermediate transfer belt 6 (primary transfer) through primary rollers 7Y, 7M, 7C and 7K (hereinafter collectively called primary rollers 7) to serve as a primary transfer section so as to form a combined color image. On the other hand, after image transfer, residual toner on the photoconductive drums 1Y, 1M, 1C and 1K is cleared by cleaning section 5 of each color.

The primary transfer rollers 7 press the intermediate transfer belt 6 onto the photoconductive drums 1 from a rear surface side of the intermediate transfer belt 6. As a result, a transfer nip is formed between the intermediate transfer belt 6 and the photoconductive drum 1.

The sheet S stored in a sheet storing section (tray) 21 of the sheet feeding device 20 is fed through a first sheet feeding section 22, and conveyed to a secondary transfer roller 9 to serve as a "secondary transfer section" via sheet feeding rollers 23, 24, 25A, and 25B and a registration roller (secondary sheet feeding section) 26, then the color image is transferred onto the sheet S (secondary transfer).

Since three-tiered sheet storing sections 21 disposed in a vertical direction in parallel at a lower portion of the image forming apparatus have the substantially the same configuration, they are denoted by the same reference symbols. The sheet feeding device 20 includes the sheet storing sections 21 and sheet feeding sections 22.

The sheet S on which the color image has been transferred is grasped by the fixing device 30. By applying heat and pressure, the color toner image (or toner image) on the sheet S is fixed on the sheet S. Then the sheet S on which the color toner image (or toner image) has been fixed is grasped and conveyed by a conveyance roller pair 37 and ejected through a sheet ejection roller 27 disposed at an ejection sheet conveyance path and then placed on a sheet ejection tray 90 outside the apparatus.

On the other hand, after the color image is transferred onto the sheet S through the secondary transfer roller 9, a cleaning section 69 clears the residual toner on the intermediate transfer belt 6 from which the sheet S has been released by curvature.

In case both surfaces of the sheet S are to be printed, after fixing the image formed on the first surface of the sheet S, the sheet S branches from the ejection sheet conveyance path via a branching plate 29 and goes into a both surfaces conveyance path 28, then the sheet S flips upside down, after that the sheet S is conveyed from a sheet feeding roller 25B. On the second surface of the sheet S, an image of each color is formed through the each of image forming deices 10Y, 10M, 10C and 10K, whereby images are formed on both the surfaces of the sheet S. Then the sheet S is subject to the pressure heat fixing process through the fixing device 30 and ejected outside the apparatus through the sheet ejection rollers 27.

Figure 2:
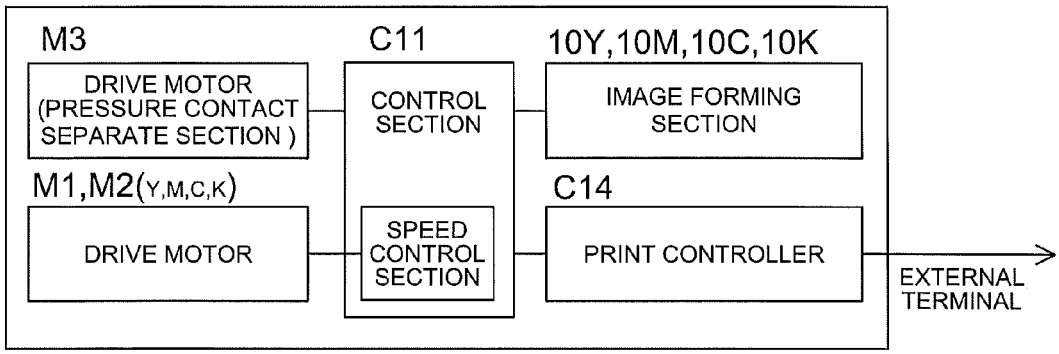
FIG. 2 is a control block diagram of an image forming apparatus related to the present embodiment.

FIG. 2 is a control block diagram of the image forming apparatus related to the present embodiment. In FIG. 2, relevant portions necessary to describe operation of the present embodiment and their peripheries are mainly shown. Other known portions as the image forming apparatus are omitted. Also, to prevent duplication of description, common portions are denoted by the same symbols which will substitute for further descriptions.

In FIG. 2, the control section C11 is to control entire operation of the image forming apparatus provided with a CPU, a ROM and a RAM. In the ROM, various kinds of programs are stored and a program downloaded to the RAM is executed by the CPU. In the ROM of the control section C11, various kinds of tables to be described, such as control tables for revolution of the drive motors are stored.

The control section C11 is provided with a speed control section, which controls and varies the moving speed of the intermediate belt 6 and the photoconductive drum 1 by controlling the revolution speed of the drive motor M1 to drive and rotate the intermediate transfer belt 6, and the drive motors $M2_Y$, $M2_M$, $M2_C$ and $M2_K$ to rotate photoconductive drums 1 respectively.

A symbol M3 denotes a drive motor to operate the pressure contact release section T so as to contact the primary transfer roller 7 onto the intermediate transfer belt 6 with pressure and release the roller.

A print controller C14 having a network I/F receives a print job from an external terminal such as an external PC connected via a network. The print job received is converted by a prescribed page-description language into image data having a data form which is capable of forming the image in the image forming section 10, and temporally stored in the control section C11 along with control data included in the print job.

<Pressure Contact and Release>

Figure 3:
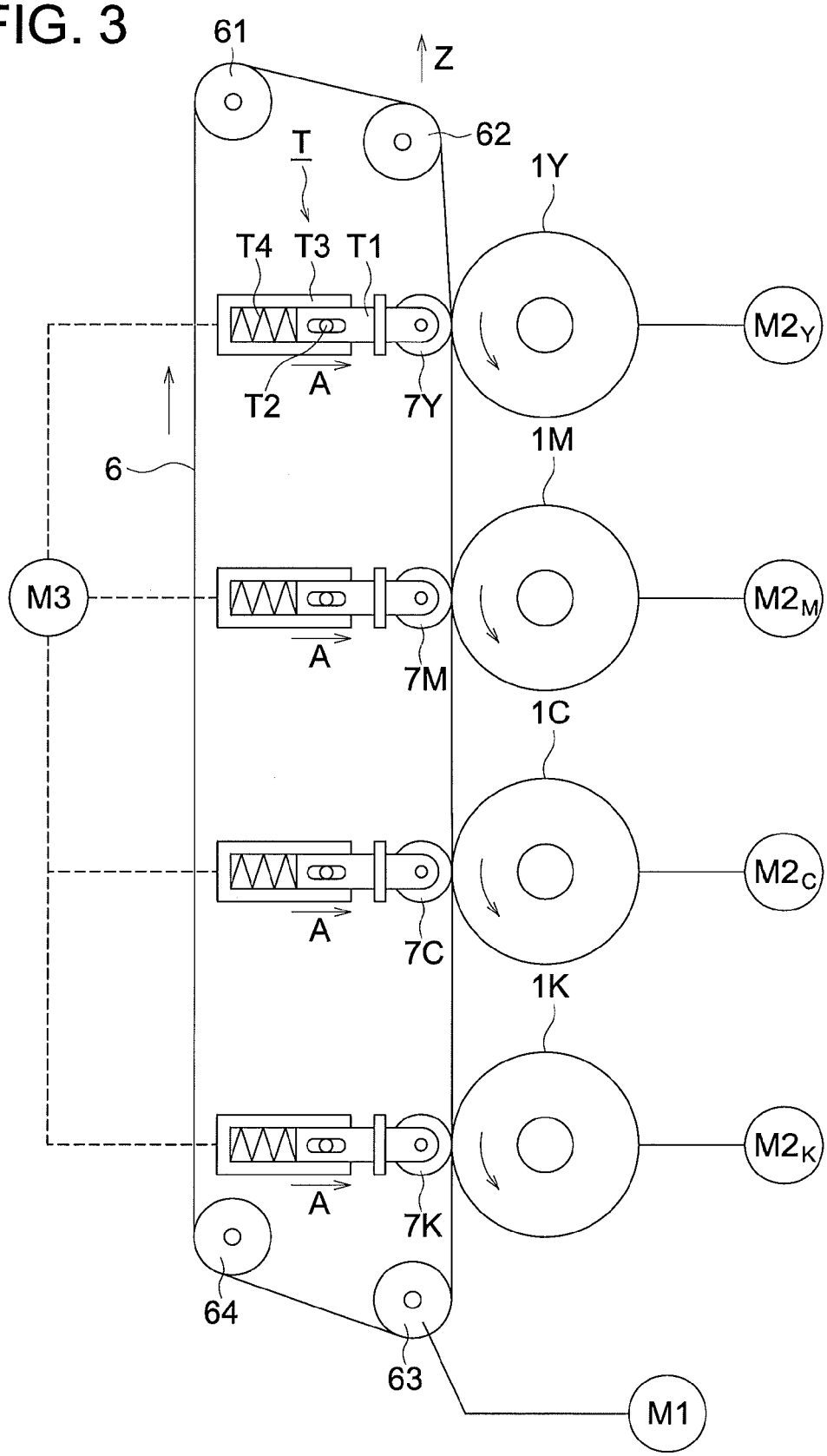
FIG. 3 shows a magnified view of a periphery of an intermediate transfer belt 6 in a state of a second mode (full color mode).
Figure 4:
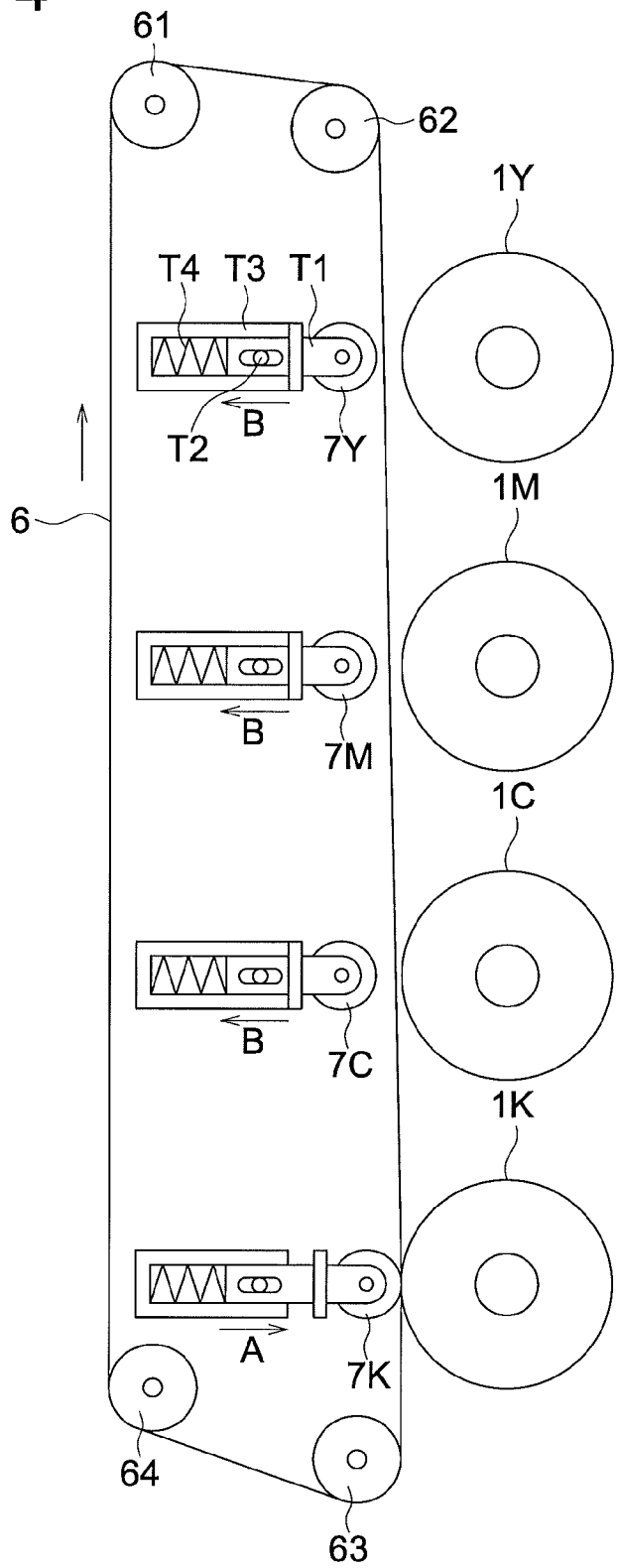
FIG. 4 shows a magnified view of a periphery of an intermediate transfer belt 6 in a state of a first mode (monochrome color mode).

FIG. 3 and FIG. 4 are magnified views of a periphery of the intermediate transfer belt 6. The intermediate transfer belt 6 is supported by rollers 61 and 64, a tension roller 62 and a drive roller 63. The tension roller 62 biases the intermediate transfer belt 6 in a Z direction shown by an arrow in the figure to prevent the belt from slackness.

A symbol T denotes the pressure contact release section configured with a base T1, a pin T2, a guide T3 and a spring T4. A rotation axis of the primary transfer roller 7 is supported by the base T1. The base T1 slides and moves in side the guide T3 in a direction A shown by an arrow by a pressure of the spring T4 so as to press the primary transfer roller 7 onto the photoconductive drum 1. The pin T2 restricts the travel of the bass T1.

Symbols M1, $M2_{Y\text{-}K}$ and M3 denote drive motors. The drive motor M1 drives the drive roller 63 to rotate the intermediate transfer belt 6. The drive motors $M2_Y$, $M2_M$, $M2_C$ and $M2_K$ (hereinafter collectively called simply drive motors M2) rotate the photoconductive drums 1 respectively. Meanwhile, the drive motors M2 can vary rotation speed individually so as to change the moving speed of the photoconductive drums 1. The drive motor M3 operates the pressure contact release sections T to switch between a contact pressure state where the primary transfer rollers 7 press the intermediate transfer belt 6 onto the photoconductive drums 1 from the back side and a released state where the primary transfer rollers 7 do not press.

FIG. 3 shows a state of a second mode (full color mode). In the second mode, the primary transfer rollers 7Y, 7M, 7C and 7K are in the pressure contact state where the full color image can be formed.

FIG. 4 shows a state of the first mode (monochrome mode). In the first mode, only the primary transfer roller 7K is in the pressure contact state by operation of the pressure contact release section T, and other primary transfer rollers 7Y, 7M and 7C are in the released state wherein the axes of the transfer rollers 7 have shifted to an arrow B direction.

<Setting of Moving Speeds of Intermediate Transfer Belt 6 and Photoconductive Drum 1>

Here, setting of the moving speed of the intermediate transfer belt 6 and the photoconductive drums 1 will be described. Incidentally, in what follows, the moving speed of the intermediate transfer belt 6 is Vb, the moving speed of the photoconductive drum 1 is Vd (or $Vd_Y$, $Vd_M$, $Vd_C$, and $Vd_K$), and the difference of both the speeds is D=Vb−Vd. Also, the speed differences D in the first mode (monochrome mode), and the second mode (full color mode) are respectively denoted by adding suffixes such as the speed differences D1 and D2.

(1) In the tandem method, it is preferred that the speed of the intermediate transfer belt 6 is a standard since a longitudinal magnification (magnification of sub-scanning direction) has to be adjusted on the sheet.

(2) In respect to rotate control of the intermediate transfer belt 6, both an average value and variation of the moving speed of the intermediate transfer belt 6 have to be controlled with high accuracy. The former causes a problem of magnification and the latter causes uneven pitch in the sub-scanning direction and color shift.

Figure 5:
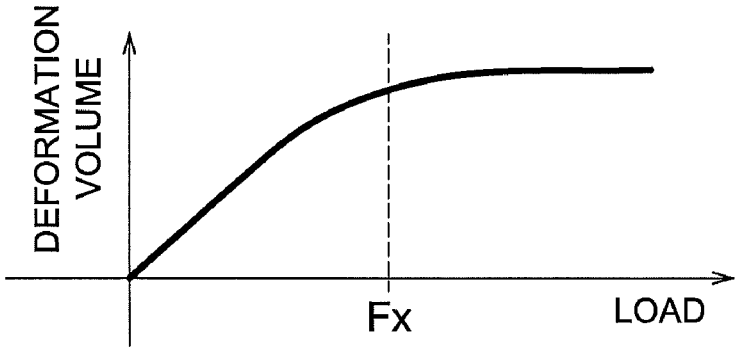
FIG. 5 is a schematic diagram showing a relation between a load (weight) and a deformation volume.

(3) In order to control rotation drive in a high accuracy, it is preferred to continuously apply a load more than a prescribed load onto a drive system of the intermediate transfer belt 6. Because elastic deformation is caused by applying the load onto the drive system of the intermediate transfer belt 6, and the deformation amount varies with fluctuation of the load. Also, when the load is light, a fluctuation of the deformation amount is large however, if the load is greater than the prescribed load, the fluctuation of the deformation amount tends to be saturated. FIG. 5 is a schematic diagram showing a relation between the load and the deformation amount. In the system shown by the diagram, the fluctuation of the deformation amount reduces when the load more than the prescribed value Fx is applied, thus rotation drive becomes stable.

(4) As a device to apply the load onto the drive system of the intermediate transfer belt 6, the photoconductive drum in pressure contact (through bias of the primary roller 7) with the intermediate transfer belt 6 is preferred to be used. By setting the moving speed Vd of the photoconductive drum 1 lower than the moving speed Vb of the intermediate transfer belt 6 (Vb>Vd), the load can be applied onto the intermediate transfer belt 6 in rotation. Incidentally, it is possible to apply the load onto the intermediate transfer belt 6 by providing a dedicated brake system, however the configuration becomes complicated since a position to which the load is applied has to be a vicinity of the intermediate transfer belt 6 and applying a stable load for a long time of period is difficult, thus the brake system is not practical.

(5) By lowering the moving speed Vd of the photoconductive drum further, the speed difference D between the intermediate transfer belt 6 and the photoconductive drum 1 becomes large, on the other hand since the photoconductive drum 1 is driven while being pulled by the intermediate transfer belt 6, the load of the photoconductive drum reduces. In the drive system of the photoconductive drum 1, if the load is excessively light (for example, no load or negative load) controllability of rotation drive is deteriorated and problems such as color shift and uneven pitch occur. Therefore, the problem occurs even if the moving speed difference D is excessively large.

(6) Also, though it is not significant, it is known that there is a tendency that color shift is remedied as the moving speed difference D reduces.

This is because a conveyance force, created by an electro static adhesion force due to an applied voltage and a frictional force via a bias force of the primary transfer roller, is operating between the photoconductive drum 1 and the intermediate transfer belt 6, however the conveyance force fluctuates with unevenness of surface condition of the intermediate transfer belt 6 and an amount of the toner image existing between the photoconductive drum 1 and the intermediate transfer belt 6, i.e. a printing duty. It is considered that since slippage between the intermediate transfer belt 6 and the photoconductive drum 1 having the moving speed difference D occurs or does not occur depending upon the aforesaid fluctuation of the conveyance force, color shift is magnified locally at an area where slippage occurs.

(7) For the above background, an optimum value of the moving speed difference D is preferred to be set as small as possible in the range where the relation of Vb>Vd is maintained, taking account the fluctuation of the speed in rotation, namely the rage where the moving speed Vb of the intermediate transfer belt 6 is not smaller than the moving speed Vd of the photoconductive drum 1 (the rage where the relation of speed is not reversed).

Figure 6:
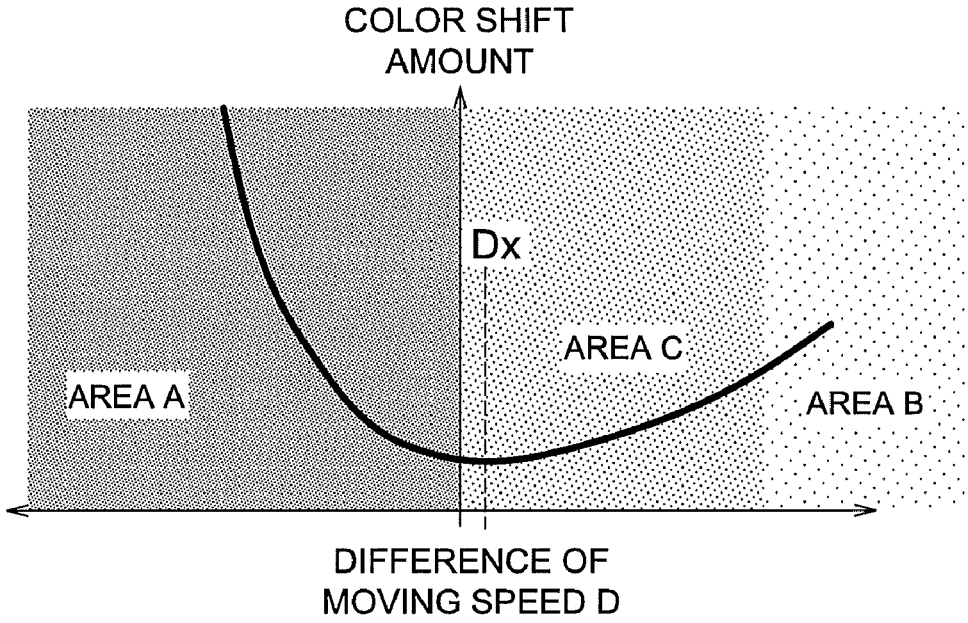
FIG. 6 is a schematic diagram showing a relation between a moving speed difference D and color shift.

FIG. 6 is a schematic diagram showing a relation between the moving speed difference D and color shift. In an area A shown in FIG. 6, since a magnitude relation between both the sides are reversed (Vb<Vd), the intermediate transfer belt 6 rotates while being pushed by the photoconductive drum 1 in the rotation direction and the fluctuation of the speed of the drive system of the intermediate transfer belt 6 due to deformation is magnified and then the color shift is magnified. Further if the moving speed of the intermediate transfer belt 6 becomes too slow compared to that of the photoconductive drum 1, gears and couplings of the drive system of the intermediate transfer belt 6 are unsettled (the gears and couplings move freely by being pushed forward), thus positional accuracy is deteriorated. On the other hand, if the moving speed difference D between both sides is too large as an area B shown in FIG. 6, as described in the item (5), the load of the drive system of the photoconductive drum 1 becomes too light and the color shift is magnified.

An area C in FIG. 6 is a preferable area. As described in item (7), the optimum value is the moving speed difference Dx which is a smaller value in the range where the relation of Vb>Vd is maintained, namely in the range where the above speed relation is not reversed. Incidentally, the optimum value of the moving speed difference Dx varies with variation of the moving speeds of the intermediate transfer belt 6 and the photoconductive drum 1. For example, given that the a set value of the moving speed Vb of the intermediate transfer belt 6 is 400 mm/sec, the optimum value of the moving speed Vd of the photoconductive drum 1 is 399.6 mm/sec and the moving speed difference Dx is 0.4 mm/sec. In the above case, a difference ratio is approximately 0.1%. Incidentally, the moving speeds $Vd_Y$ $Vd_M$ $Vd_C$ and $Vd_K$ of the photoconductive drums 1Y to 1K are set at the same speed.

<Control Flow>

Figure 7:
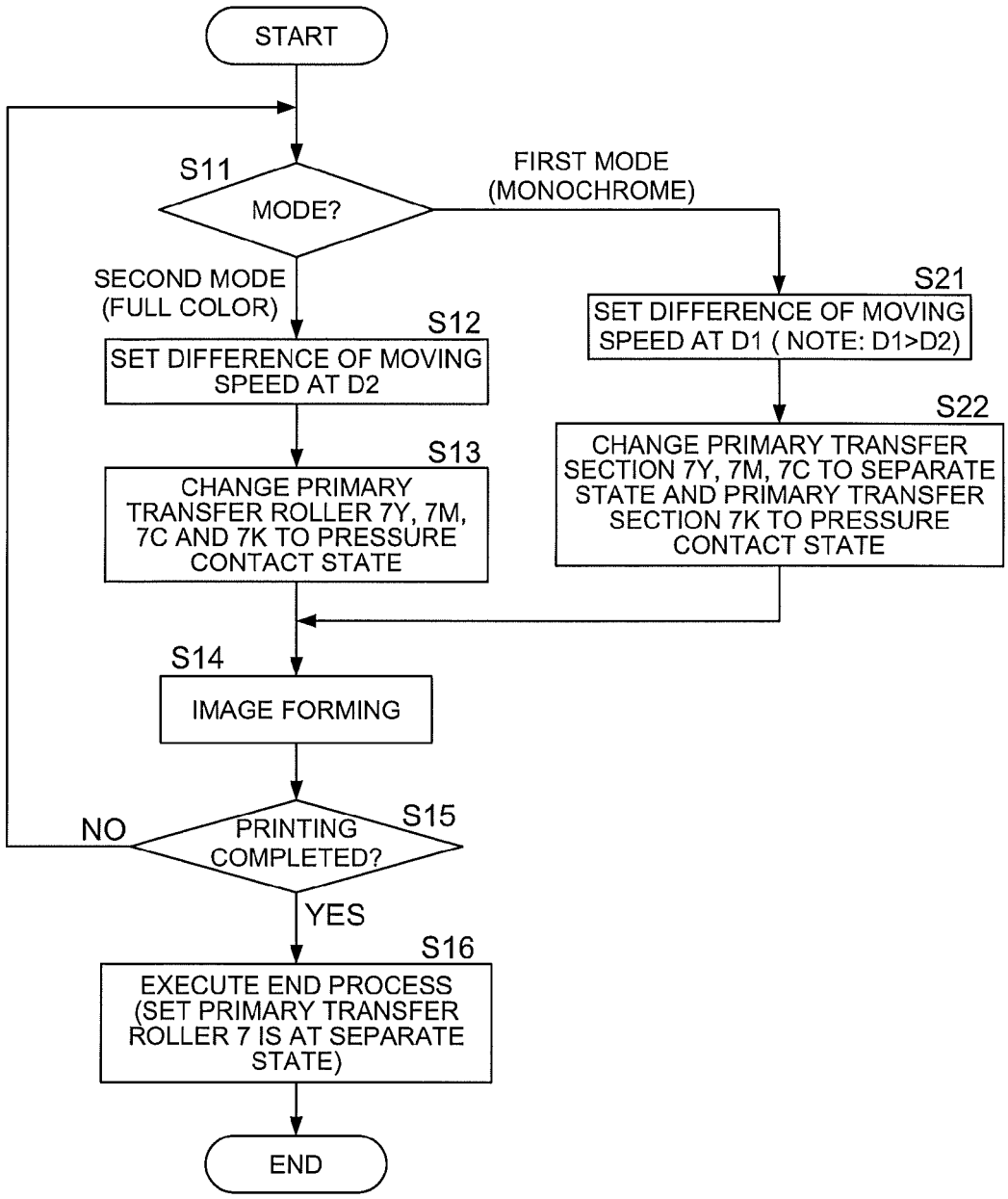
FIG. 7 is a control flow which a control section C11 of an image forming apparatus executes.

Next, a control flow will be described. FIG. 7 is the control flow executed by the control section C11 of the image forming apparatus.

In Step S11, whether the current job mode is the first mode (monochrome) or the second mode (full color) is judged with reference to control data of the print job to be executed.

If it is judged to be the second mode, the speed difference (Vb−Vd) between the intermediate transfer belt 6 and the photoconductive drum 1 is set to be D2 in a subsequent Step S12. In the former example, the moving speed difference D2 is 0.4 mm/sec (the moving speed Vb is 40 mm/sec, the moving speed Vd is 399.6, the moving speed difference D2 is 0.4 mm/sec and the difference ratio is 0.1%).

In Step S13, by operating the pressure contact release section T, all the primary transfer rollers 7 of Y, M, C and K colors are changed to be in the pressure contact state. In this case, as mention in the forgoing, the intermediate transfer belt 6 received the load from the photoconductive drums 1Y, 1M, 1C and 1K.

On the other hand, if it is judged to be the first mode in Step 11, the speed difference (Vb−Vd) between the intermediate transfer belt 6 and the photoconductive drum 1 is set to be D1 in a subsequent Step S21. This means that by lowing the moving speed Vd of the photoconductive drum 1 in the first mode than that of the second mode, the moving speed difference D1 in the first mode becomes greater than the speed difference D2 in the second mode. In the above example, the speed difference D1 is 2.0 mm/sec (the moving speed Vd is changed from 399.6 mm to 398.0 mm/sec and the moving speed Vb is remained at 400 mm/sec. The difference ratio is 0.5%). The reason will be described later. Incidentally, the moving speed difference can be magnified by making the moving speed of the intermediate transfer belt 6 in the first mode faster than that in the second mode. In the above case, since a change of a longitudinal magnification ratio tends to occur, a lateral magnification ration (change of writing clock frequency) has to be changed at the same time.

Subsequently, in Step S14, printing job is executed to form an image until the printing job is completed (Step S15).

In Step S16, an end process is executed. In the end process, all the primary rollers 7 are changed to be the release state and drive motors M1 and M2 halt to end.

Here, the reason that the moving speed D1 in the first mode (monochrome) is made greater that the moving speed D2 in the second mode (full color mode) will be described. In the present embodiment, as described in the foregoing <Setting of moving speed>, the load is applied to the intermediate transfer belt 6 by lowering the moving speed Vd of the photoconductive drum 1 than the moving speed Vb of the intermediate transfer belt 6. Also, as described in FIG. 3 and FIG. 4, it is configured so that the primary transfer rollers 7 can be switched between the pressure contact state and the released state by operating presser contact release section T.

As the above configuration, in the second mode (full color), the four photoconductive drums 1Y, 1M, 1C and 1K apply load onto the intermediate transfer belt 6. On the other hand, in the first mode (monochrome), only the primary transfer roller 7K is in the pressure contact state. The load applied to the intermediate transfer belt 6 is given by one photoconductive drum 1K. Namely, in the first mode, the number of the photoconductive drums in contact with the intermediate transfer belt 6 is one fourth of that in the second mode, thus the load onto the intermediate transfer belt 6 reduces, and as a result the intermediate transfer belt 6 cannot be controlled to rotate with high accuracy.

To cope with the above problem, as the control flow in FIG. 7 shows, in the first mode, by further increasing the moving speed D1, compared to that in the second mode, the load applied by the photoconductive drum 1K onto the intermediate transfer belt 6 increases compared to the second mode, and decreasing of the load due to the number of the photoconductive drums 1 in contact is one fourth can be compensated. Incidentally, the load applied to the photoconductive drum 1K is reduced by pulling of the intermediate transfer belt 6, resulting in deterioration of controllability of the rotation drive of the photoconductive drum 1. However, in the first mode (monochrome), toner images do not have to be overlapped inherently, color shift is not necessary to be considered and only irregular pitch to be considered. In general, since a tolerance for irregular pitch is wider than that of color shift, it cannot be a serious problem. Incidentally, the moving speed Vb of the intermediate transfer belt 6 and the moving speed Vd of the photoconductive drum 1 are stored in a memory section (not illustrated) respectively in respect to the modes and read out in accordance with the modes.

In the present embodiment, in a configuration where the number of the photoconductive drums in contact with the intermediate transfer belt differs between the color mode and the monochrome mode, the intermediate transfer belt can be controlled with a high degree of accuracy while maintaining optimum color shift performance in a color mode and suppressing an effect of change of number of the photoconductive drums.

According to the present embodiment, in a configuration where the number of the photoconductive drums varies with the modes, it becomes possible to provide an image forming apparatus to control the intermediate transfer belt with high accuracy while optimizing color shift performance of the toner image and suppressing the effect caused by reducing number of the photoconductive drums in contact.

What is claimed is:

1. An image forming apparatus, comprising:

a plurality of image carriers on which different colors of toner images are formed respectively;

an intermediate transfer belt;

a plurality of primary transfer sections, disposed respectively to correspond to the plurality of the image carriers, to transfer each color of toner images formed on the plurality of the image carriers onto the intermediate transfer belt for forming an overlapped color toner image, wherein the primary transfer sections press the intermediate transfer belt from a back side so that the intermediate transfer belt comes in pressure contact with the image carriers so as to create transfer nips between the intermediate transfer belt and the image carriers;

a secondary transfer section to transfer the overlapped color toner image formed on the intermediate transfer belt onto a sheet;

a pressure contact release section to drive and switch the plurality of the primary transfer sections between a pressure contact state where the intermediate transfer belt is in pressure contact with the image carrier and a release state where the intermediate transfer belt is released from the image carrier;

a plurality of drive motors to drive rotation of the image carriers and the intermediate transfer belt independently and respectively, capable of varying each moving speed thereof; and a control section to control the pressure contact release sections and the drive motors, wherein a moving speed difference is a moving speed Vb of the intermediate transfer belt minus a moving speed Vd of the image carrier, where Vb>Vd, and the control section controls the pressure contact release sections so as to execute a first mode to form a toner image wherein at least one primary transfer section is in the pressure contact state, and a second mode to form the toner images wherein a greater number of the primary transfer sections than that in the first mode are in the pressure contact state, and the control section controls the drive motors in accordance with the modes so that the moving speed difference of the image carrier(s) of the primary transfer sections that are in the pressure contact state in the first mode is greater than that in the second mode.

2. The image forming apparatus of claim 1, wherein the control section controls a first drive motor so that the moving speed of the image carrier in pressure contact with the intermediate transfer belt in the first mode is slower than that in the second mode.

3. The image forming apparatus of claim 2 wherein the control section controls a second drive motor so that the moving speed of the intermediate transfer belt in the first mode is faster than that in the second mode.

4. The image forming apparatus of claim 1, wherein the moving speed Vb of the intermediate transfer belt and the moving speed Vd of the image carrier are stored in a memory section in accordance with the modes.

5. The image forming apparatus of claim 1, wherein a longitudinal magnification ratio of the color toner image is changed in accordance with a level of change of the moving speed of the intermediate transfer belt.

* * * * *